United States Patent [19]

Hamer

[11] Patent Number: 4,850,401

[45] Date of Patent: Jul. 25, 1989

[54] WEFT YARN STORE AND AN ELECTROMAGNETIC YARN CLAMP THEREFOR

[75] Inventor: Antonius Hamer, Eindhoven, Netherlands

[73] Assignee: Sulzer Brothers Limited, Winterthur, Switzerland

[21] Appl. No.: 179,437

[22] Filed: Apr. 8, 1988

[30] Foreign Application Priority Data

Apr. 8, 1987 [CH] Switzerland ..... 01348/87

[51] Int. Cl.[4] ..... D03D 47/34

[52] U.S. Cl. ..... 139/452

[58] Field of Search ..... 139/452; 242/47.01, 242/47.12; 335/255 XR, 257, 1 XR; 200/306 XR

[56] References Cited

U.S. PATENT DOCUMENTS

| | | | |
|---|---|---|---|
| 3,599,128 | 8/1971 | Fruth | 335/1 |
| 3,944,774 | 3/1976 | Noba et al. | 200/306 |
| 4,203,084 | 5/1980 | Yamaguchi et al. | 200/306 |
| 4,632,155 | 12/1986 | Maina | 139/452 |

*Primary Examiner*—Henry S. Jaudon

*Attorney, Agent, or Firm*—Kenyon & Kenyon

[57] ABSTRACT

The weft yarn store includes a stationary drum for a supply of weft yarn as well as an electromagnetic yarn clamp for retaining the weft yarn on the drum periphery. The clamp includes a locking pin which is connected to an armature of the electromagnet for pressing a yarn against an abutment surface of the drum. The electromagnetic yarn clamp is also provided with apertures through which cooling air may flow into and through the clamp in order to cool the winding and armature. In addition, the cooling air may be directed onto the abutment surface of the drum to keep this area free from deposits of fluff.

13 Claims, 2 Drawing Sheets

WEFT YARN STORE AND AN ELECTROMAGNETIC YARN CLAMP THEREFOR

Figure 1:
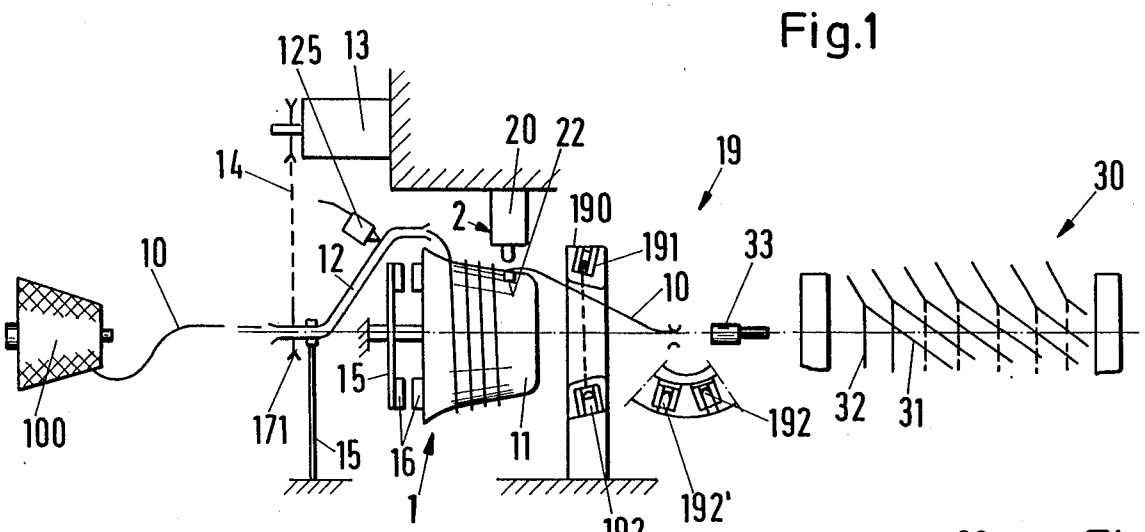

This invention relates to a weft yarn store for a loom and to an electromagnetic yarn clamp therefore.

Heretofore, various types of weft yarn stores have been known for feeding weft yarns into a loom for picking purposes In some cases, the weft yarn stores have included a stationary drum for storing a weft yarn supply thereon for release of at least some of the supply into the loom during picking. Various types of clamps have also been known for retaining the weft yarn on the drum at the end of picking.

For example, Swiss Pat. No. 647,999 describes a weft yarn store which employs a stationary drum and an electromagnetic yarn clamp for retaining a weft yarn on the periphery of the drum at the end of picking. As described, the yarn clamp includes an electromagnet and a locking pin which is driven in a reciprocating manner by the electromagnet in order to abut the drum and retain a weft yarn thereat. As is known, the clamp must be closed very rapidly at the end of each pick from the weft yarn store if an accurately dimensioned length of weft yarn is to be picked. Further, the locking pin must move into a closed position within the time taken to draw a winding of yarn off the drum periphery. Still further, at the high picking rates of modern air jet looms and the high picking frequencies, substantial forces are required to actuate the locking pin to ensure that movement occurs within the required short time. This requires, for example, a strong spring in the clamp in order to disengage the pin from the drum and a generously dimensioned electromagnet which is able to overcome the spring force.

It is also known that the pin movements in a yarn clamp of the above type are limited by abutments which comprise, to some extent, resilient materials having good damping properties to ensure that the pin does not continue to oscillate after the termination of a stroke and after an abutment position has been reached.

The fact that substantial forces occur within an electromagnetic yarn clamp of the above type and that the "on" time is relatively long, leads to considerable heating of the electromagnet and, particularly of the resilient abutments. As a result, there is a possibility of a reduction in the working life of the electromagnet and abutments as well as of altered damping properties of the abutments.

Accordingly, it is an object of the invention to increase the working life of an electromagnetic yarn clamp for a weft yarn store.

It is another object of the invention to minimize the heating Effect within an electromagnetic yarn clamp of a weft yarn store.

It is another object of the invention to provide a relatively simple electromagnetic yarn clamp structure possessing a relatively long useful life.

Briefly, the invention provides a weft yarn store for a loom comprising, a stationary drum for storing a weft yarn supply thereon, and an electromagnetic yarn clamp for retaining the weft yarn on the drum at the end of picking and having means for guiding a flow of cooling air through the yarn clamp.

The stationary drum is of any suitable construction and serves to store a plurality of circumferential windings thereon for release into a loom during picking.

The electromagnetic yarn clamp includes a stationary winding, a armature coaxially within the winding to define a gap therebetween and a locking pin which is connected to the armature for abutting the drum in an extended position of the armature in order to clamp a weft yarn thereat. In addition, a stop pad disposed opposite a hammer on the armature is provided with an aperture through which a flow of coolant such as cooling air may be delivered. When the armature is in the retracted position, the hammer closes over the aperture while, when the armature is an extended position, the aperture is opened to permit a flow of coolant into the clamp for cooling of the armature and winding.

The yarn clamp is also provided with at least one aperture for directing the flow of coolant towards the drum for cleaning the surface of the drum adjacent the locking pin.

During operation, the coolant, which is in the form of cooling air, such as compressed air, flows through the yarn clamp parallel to the direction of magnet movement and through at least one of the abutments as well as through the gap between the winding and the armature. The cooling air exits the yarn clamp through the apertures directed towards the drum so that the cooling air is also used to clean the drum surface near the yarn clamp by blowing away deposits of fluff on the weft yarn and other particles of dirt.

Figure 3B:
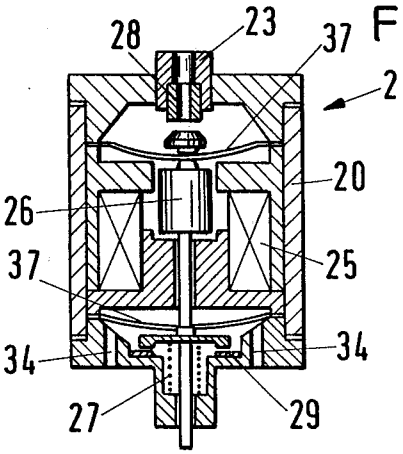
Figure 3A:
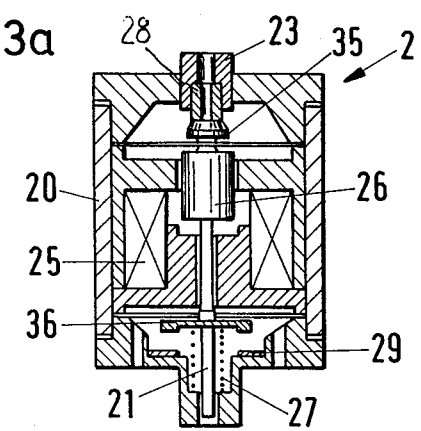
Figure 2:
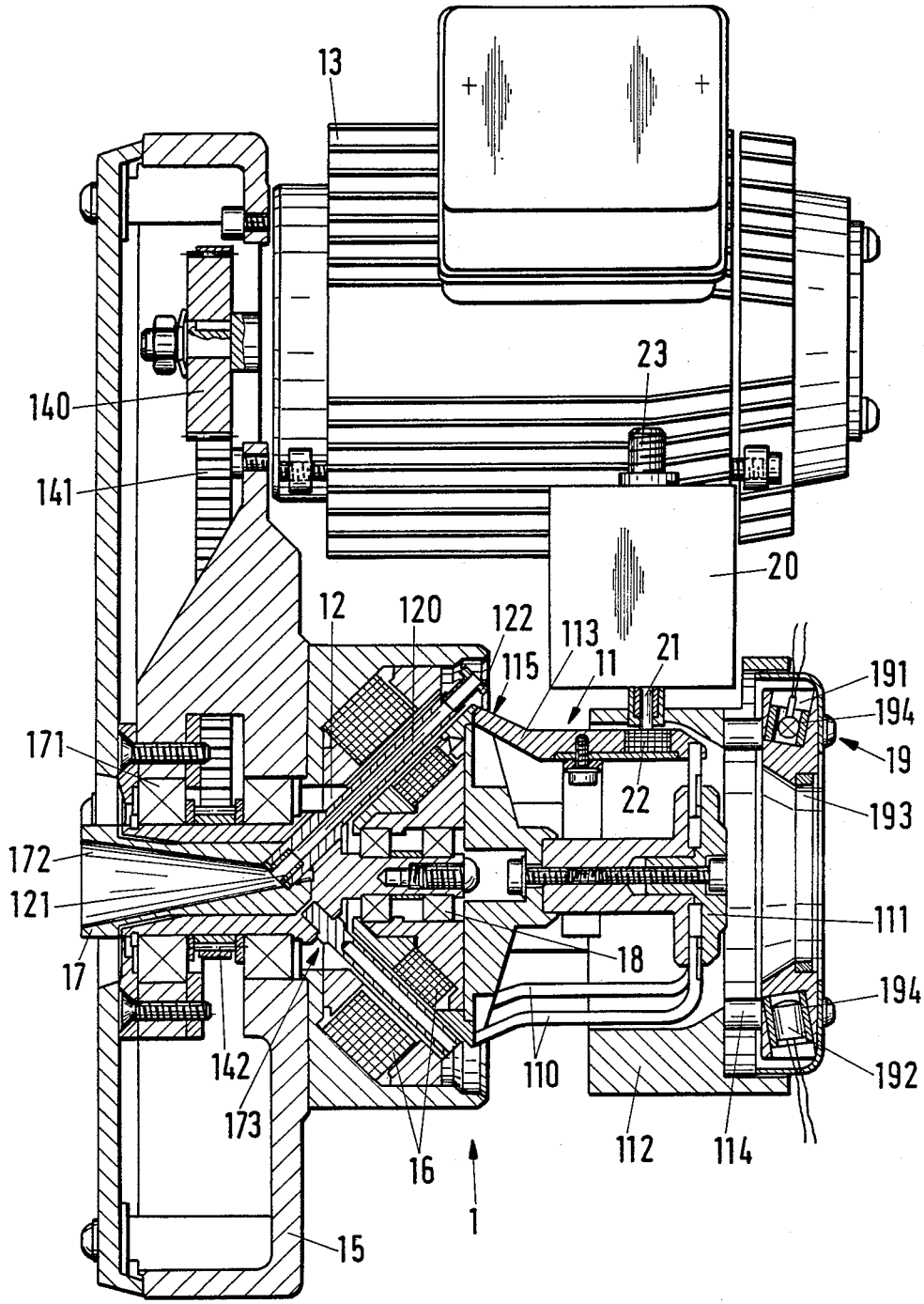

These and other objects and advantages of the invention will become more apparent from the following detailed description taken in conjunction with the accompanying drawings wherein:

FIG. 1 schematically illustrates a weft yarn store for a loom employing an electromagnetic yarn clamp constructed in accordance with the invention;

FIG. 2 illustrates a part cross sectional view of the weft yarn store of FIG. 1;

FIG. 3*a* illustrates a cross sectional view of the electromagnetic yarn clamp; and FIG. 3*b* illustrates a view similar to FIG. 3*a* of the weft yarn clamp in an extended position.

Referring to FIG. 1, a weft yarn 10 to be processed in a loom 30 is drawn off a yarn package 100 by a weft yarn store 1 and subsequently delivered to the loom 30. As indicated, the weft yarn store 1 includes a winder 12 for winding the weft yarn in a plurality of windings onto a stationary drum 11. In addition, a control facility 19 is provided along with an air jet nozzle 33 for picking the weft yarn 10 into a shed formed by warp yarns 31, 32 in the loom 30.

Referring to FIG. 2, the weft yarn store 1 includes a funnel 172 within a winder shaft 17 through which the weft yarn enters prior to passage into the winder 12. The winder 12 which is shown schematically in FIG. 1 is formed of a tube 120 having eyes 121, 122 at opposite ends. This tube 120 is secured in the shaft 17 in known manner. In addition, a rod 173 which functions as a counterweight is disposed diametrically opposite the winder tube 120.

The winder shaft 17 is mounted via bearings 171 in a casing 15 and is driven by a controlled electric motor 13 by way of a drive 14, such as a belt drive 140, 141, 142. The drum 11 is mounted via radial bearings 18 on the winder shaft 17 and is prevented from rotating with the shaft 17 by magnet pairs 16. One magnet of each pair is disposed in the casing 15 and the other magnet is disposed in the drum 11.

An envelope 113 extends over only some of the periphery of the drum 11 while the remainder of the drum 11 is formed by stirrups 110 having bent ends which converge radially at a flange 111. The flange 111 is, in turn, operative to retain the stirrups 110 and facilitates radial adjustment of the stirrups so that the periphery of the drum can be varied in accordance with the weft yarn length required in the loom 30. After the weft yarn has been deposited on a conical part 115 of the drum 11, the windings of weft yarn slide to the right, as viewed in FIG. 2 onto the cylindrical part of the drum 11 for intermittent withdrawal therefrom.

The construction of the drum is generally conventional and need not be further described.

Referring to FIG. 1, the weft yarn store includes an electromagnetic yarn clamp 2 which cooperates with the drum 11 in order to retain the weft yarn 10 thereon after picking. As indicated, the weft yarn clamp 2 employs an electromagnet 20 which is disposed opposite an abutment surface 22 of the drum 11 for clamping the weft yarn thereat.

Referring to FIG. 2, wherein like reference characters indicate like parts as above, the electromagnet 20 has a locking pin 21 which is reciprocably mounted to engage against the abutment surface 22 of the drum 11.

Referring to FIG. 3*a*, the electromagnet 20 includes a stationary winding 25 and an armature 26 which is coaxially mounted within the winding 25 to define a gap therebetween and which is connected at one end to the locking pin 21 to form a locking element. In addition, spring strip rings 37 are disposed within the electromagnet 20 to guide the locking element therein. In this respect, the armature 26 is movable between a retracted position (FIG. 3*a*) and an extended position (FIG. 3*b*).

A compression spring 27 is disposed in the bottom part of the electromagnet 20, as viewed, for biasing the armature 26 from the extended position into the retracted position. In addition, an abutment in the form of a stop pad 28 is mounted in alignment with a hammer or head 35 on the end of the armature 26 opposite the locking pin 21. This stop pad 28 is provided with a central aperture and is mounted within an air connection boss 23 through which a coolant, such as compressed air, may flow into the interior of the electromagnet 20 from a suitable source (not shown).

An abutment cup 36 is disposed on the pin 21 to abut the spring 27 and to abut against an abutment ring 29 when the armature 26 is in the extended position (FIG. 3B). In addition, at least two apertures 34 are provided at the lower end of the electromagnet 20 to expel coolant therefrom.

When the electromagnet 20 is in the normal or retracted position, the armature 26 is biased by the compression spring 27 against the abutment pad 28. Thus, the aperture in the pad 28 is closed so that cooling air may not flow into the electromagnet 20. When the winding 25 is energized, the armature 26 is drawn downwardly, as viewed, against the force of the compression spring 27 into the extended position as illustrated in FIG. 3*b* so that the pin 21 is pressed onto the abutment surface of the drum 11 (not shown) At this time, the aperture in the pad 28 is opened to the flow of cooling air so that the air may flow into the interior of the electromagnet 20. The air then flows past the hammer 35 along the armature 26 towards the apertures 34. During this time, the air flows through the gap between the winding 25 and armature 26 in a direction parallel to the locking pin 21. The aperture of the stop pad 28 and the apertures 34 thus define a means for guiding the cooling air through the yarn clamp and particularly past the winding 25 and armature 26 to cool the same.

Referring to FIG. 3*b*, the air which exits through the apertures 34 is directed towards the drum 11 so that at least the zone near the abutment surface 22 is cleaned of deposits.

The effect of compressed air flowing through the electromagnet 20 is that the electromagnet is cooled overall, particularly the pad 28 and the winding 25. Further, since the hammer 35 functions as a shutoff element, compressed air is consumed only when the clamp is in the operative position, that is when the abutment cup 36 is in abutment with the abutment ring 29.

Referring to FIG. 2, the store 1 may also have a cap 112 which engages around the delivery end of the drum 11. As indicated, the cap 112 bounds a narrow annular gap with the drum 11 for braking the windings of yarn leaving the store. The monitoring facility 19 which is mainly comprised of a monitoring ring 190, a transmitter 191 and a receiver 192 is secured by pins 114 to the cap 112. The ring 190 is made of a transparent material, such as Plexiglass and serves to limit a balloon of departing weft yarn exiting therethrough. In addition, the exit edge of the ring 190 is protected by a wear or replacement ring 193 made, for example, of hardened steel or of ceramic.

The transmitter 191 and receiver 192 together form a light barrier. In addition, a jacket 194 extends around the transmitter 191 and receiver 192. During operation, a weft yarn 10 coming off the drum 11 briefly interrupts the beam path between the transmitter 191 and receiver 192 to cause a signal to be emitted to a suitable control (not shown). As indicated in FIG. 1, a plurality of receivers 192, 192′ may be provided to form multiple beam paths for emitting signals corresponding to the weft yarn take off. The signals may be evaluated, for example, as described in Swiss Patent No. 647,999. After the required number of windings of yarn have been drawn off the drum 11, the electromagnet 20 is operated to press the pin 21 against the abutment surface 22 of the drum 11 in order to terminate the drawing-off of the yarn 10 from the yarn 11.

Referring to FIG. 1, the function of the electric motor 13 is drive the winder 12 by way of the belt drive 14 so that the number of windings of yarn drawn off the drum 11 are immediately replaced by fresh windings of weft yarn from the package 100 in order to ensure that a sufficient number of windings of yarn are always present on the drum 11.

The overall operation of the weft yarn store is generally conventional and need not be further described.

The invention thus provides a relatively simple means for cooling the electromagnet of an electromagnetic yarn clamp.

The invention further provides an electromagnetic yarn clamp which can be retrofitted onto existing weft yarn stores.

What is claimed is:

1. A weft yarn store for a loom comprising a stationary drum for storing a weft yarn supply thereon for spontaneous release of at least some of the supply into a loom during picking; and an electromagnetic yarn clamp for retaining the weft yarn on said drum at the end of picking said clamp having means for guiding a flow of cooling air through said yarn clamp.

2. A weft yarn store as set forth in claim 1 wherein said clamp includes a reciprocally mounted pin for clamping a yarn winding on said drum and wherein said means guides the flow of cooling air in a direction parallel to said pin.

3. A weft yarn store as set forth in claim 1 wherein said clamp includes a magnet winding, a magnet armature disposed in spaced coaxially relation within said winding to define a gap therebetween, a pin secured to said armature for clamping a yarn winding on said drum and a stop pad for abutting said armature on a side opposite from said pin, said stop pad having an aperture therein and wherein said means guides a flow of cooling air through said aperture and said gap with said pin clamping a yarn winding on said drum.

4. A weft yarn store as set forth in claim 1 wherein said clamp includes at least one aperture for directing the flow of cooling air therein towards said drum for cleaning a surface of said drum adjacent said pin.

5. A weft yarn store as set forth in claim 3 wherein said clamp includes a winding, an armature within said winding and a pin connected to said armature for abutting said drum and said means includes a first aperture for guiding a flow of cooling air between said armature and winding and a second aperture for directing the air from said clamp towards said drum.

6. A weft yarn store comprising a stationary drum for storing a weft yarn supply thereon in a plurality of circumferential windings for release into a loom during picking; and an electromagnetic yarn clamp having a reciprocally mounted locking pin for engaging at least one winding on said drum following picking and means for guiding a coolant through said yarn clamp in parallel to said pin to cool said yarn clamp.

7. A weft yarn store as set forth in claim 6 wherein said clamp includes a winding and an armature coaxially within said winding and connected to said pin and wherein said means guides the coolant between said armature and said winding.

8. A weft yarn store as set forth in claim 7 wherein includes a first aperture for guiding the coolant to between said winding and said armature and at least a second aperture for directing the coolant out of said clamp.

9. A weft yarn store as set forth in claim 7 wherein said clamp further includes a stop pad having a centrally disposed aperture in communication with said means for passage of the coolant therebetween into said clamp and a hammer on said armature for abutting said stop pad to close said aperture in a retracted position of said pin.

10. A weft yarn store as set forth in claim 9 wherein said clamp includes at least one aperture for directing the flow of cooling air therein towards said drum for cleaning a surface of said drum adjacent said pin.

11. An electromagnetic yarn clamp for a weft yarn store comprising a stationary winding;

an armature coaxially within said winding and defining a gap therebetween, said armature being movable between a retracted position and an extended position;

a locking pin connected to said armature for abutting a yarn storage drum in said extended position of said armature to clamp a weft yarn thereat;

an abutment having an aperture therein; and a hammer on said armature at an end opposite said pin for abutting said abutment to close said aperture in said retracted position and to open said aperture to a flow of coolant in said extended position for cooling of said armature and said winding.

12. An electomagnetic yarn clamp as set forth in claim 11 which further comprises at least one aperture for guiding the coolant towards the yarn storage drum.

13. An electromagnetic yarn clamp as set forth in claim 11 which further comprises a spring biasing said armature from said extended position into said retracted position.

* * * * *

UNITED STATES PATENT AND TRADEMARK OFFICE

CERTIFICATE OF CORRECTION

PATENT NO. : 4,850,401

DATED : July 25, 1989

INVENTOR(S) : Antonius Hamer

It is certified that error appears in the above-identified patent and that said Letters Patent is hereby corrected as shown below:

Column 1, line 6, "therefore." should be --therefor.--
Column 1, line 55, "Effect" should be --effect--
Column 2, line 2, "a" should be --an--
Column 4, line 44 "is drive" should be --is to drive--
Column 5, line 6, "coaxially" should be --coaxial--
Column 6, line 1, before "includes" insert --said means--.

Signed and Sealed this

Seventh Day of August, 1990

*Attest:*

HARRY F. MANBECK, JR.

*Attesting Officer*

*Commissioner of Patents and Trademarks*